US007374406B2

(12) United States Patent
Moody et al.

(10) Patent No.: US 7,374,406 B2
(45) Date of Patent: May 20, 2008

(54) SYSTEM AND METHOD FOR REDUCING NOISE IN MULTI-CAPACITY COMPRESSORS

(75) Inventors: Bruce Moody, Kingsport, TN (US); Tyrone Scott Simerly, Johnson City, TN (US); Mark Trent, Bristol, VA (US); David Turner Monk, Bristol, VA (US); Scott Garrison Hix, Bristol, VA (US)

(73) Assignee: Bristol Compressors, Inc., Bristol, VA (US)

( * ) Notice: Subject to any disclaimer, the term of this patent is extended or adjusted under 35 U.S.C. 154(b) by 256 days.

(21) Appl. No.: 11/240,976

(22) Filed: Sep. 30, 2005

(65) Prior Publication Data

US 2006/0083647 A1 Apr. 20, 2006

Related U.S. Application Data

(60) Provisional application No. 60/619,090, filed on Oct. 15, 2004.

(51) Int. Cl.

| | |
|---|---|
| ***F04B 43/12*** | (2006.01) |
| ***F04B 1/06*** | (2006.01) |
| ***F04B 49/00*** | (2006.01) |
| ***F04B 7/04*** | (2006.01) |

(52) U.S. Cl. ..... 417/53; 417/221; 417/284; 417/306; 417/501; 418/201.2; 92/163; 92/181 R

(58) Field of Classification Search ..... 417/221, 417/284, 306, 307, 440, 490, 501; 418/201.2; 92/163, 181 R, 181 P See application file for complete search history.

(56) References Cited

U.S. PATENT DOCUMENTS

| | | | |
|---|---|---|---|
| 2,074,911 | A | 3/1937 | Hull |
| 2,080,288 | A | 5/1937 | McCormack |
| 3,606,588 | A | 9/1971 | Romerhaus |
| 4,026,122 | A | 5/1977 | Kuhn et al. |
| 4,280,678 | A | 7/1981 | Roberts |

(Continued)

FOREIGN PATENT DOCUMENTS

| | | | |
|---|---|---|---|
| GB | 2 122 325 | A | 1/1984 |

(Continued)

*Primary Examiner*—Charles G Freay
(74) *Attorney, Agent, or Firm*—McNees Wallace & Nurick LLC

(57) ABSTRACT

A method and system is provided for reducing chatter in multi-capacity compressors having disengageable eccentric structures. The multi-capacity fluid compressor includes a compression chamber having a discharge end and an inner surface. The compressor also includes a compression member having a disengageable eccentric structure allowing the compressor to provide discrete compression capacities. A valve portion is disposed adjacent to the discharge end of the compression chamber and is arranged and disposed to discharge a compressed fluid when the compression member has completed. A discharge arrangement is arranged and disposed to discharge at least a portion of fluid remaining in the compression chamber at the completion of the compression cycle. The discharge of at least a portion of the fluid remaining in the compression chamber reduces or eliminates forces on the disengageable eccentric structure to limit rotational acceleration of the disengageable eccentric structure.

27 Claims, 8 Drawing Sheets

U.S. PATENT DOCUMENTS

| | | | | |
|---|---|---|---|---|
| 4,479,419 | A | 10/1984 | Wolfe | |
| 4,588,359 | A | 5/1986 | Hikade | |
| 4,750,871 | A * | 6/1988 | Curwen | 417/418 |
| 4,802,830 | A | 2/1989 | Nakajima | |
| 5,261,797 | A | 11/1993 | Christenson | |
| 5,921,274 | A | 7/1999 | Schuller et al. | |
| 6,092,993 | A | 7/2000 | Young et al. | |
| 6,132,177 | A | 10/2000 | Loprete et al. | |
| 6,217,287 | B1 | 4/2001 | Monk et al. | |
| 6,261,068 | B1 * | 7/2001 | Kramer et al. | 417/297 |
| 6,318,971 | B1 | 11/2001 | Ota et al. | |
| 6,530,752 | B2 | 3/2003 | Oba et al. | |
| 6,663,358 | B2 | 12/2003 | Loprete et al. | |
| 6,702,557 | B2 | 3/2004 | Kim et al. | |
| 6,981,851 | B2 * | 1/2006 | Lilie | 417/284 |
| 2002/0187050 | A1 | 12/2002 | Narney, II et al. | |
| 2003/0183073 | A1 | 10/2003 | Lilie | |
| 2004/0131490 | A1 | 7/2004 | Choi et al. | |
| 2004/0136841 | A1 | 7/2004 | Takahashi et al. | |

FOREIGN PATENT DOCUMENTS

| | | | |
|---|---|---|---|
| JP | 58074892 | A | 5/1983 |
| JP | 59218393 | A | 12/1984 |
| JP | 59229084 | A | 12/1984 |
| JP | 61258985 | A | 11/1986 |
| JP | 62206283 | A | 9/1987 |
| JP | 62218684 | A | 9/1987 |
| JP | 05231309 | A | 9/1993 |
| JP | 08203371 | A | 8/1996 |
| JP | 2001263279 | A | 9/2001 |

* cited by examiner

300

300

300

SYSTEM AND METHOD FOR REDUCING NOISE IN MULTI-CAPACITY COMPRESSORS

FIELD OF THE INVENTION

The present invention relates generally to multi-capacity compressors having disengageable eccentric structures. More specifically, the present invention relates to a system and method for reducing noise in a multi-capacity compressor caused by a disengageable eccentric structure.

BACKGROUND OF THE INVENTION

Compressor capacity in refrigerant compressors may be varied, especially in multi-cylinder refrigerant compressors, by providing a two position eccentric cam rotatably mounted on the crankpin. The cam is angularly adjustable in response to reversing the direction of rotation of the crankpin by the crankshaft drive motor. One direction of rotation results in the positioning of the eccentric cam having a more eccentric rotation path to provide compression in a corresponding cylinder, while the opposite direction of rotation results in the position of the eccentric cam having a circular rotational path to provide a different amount of compression or no compression in the cylinder. The use of the two position eccentric cam (i.e., the disengageable eccentric cam) allows the compressor to have variable capacity by effectively removing compression in one of the cylinders for one direction of rotation and allows the compressor to maintain efficiency, while under varying load requirements.

One type of eccentric cam is described in U.S. Pat. No. 4,479,419, hereinafter the '419 Patent. The angular positioning of the cam (i.e., the eccentric cam) on the crankpin is accomplished by providing a pair of drive stops which are angularly spaced on a portion of the crankpin, and a dog provided on the cam. These stops and the dog are angularly positioned with respect to each other such that upon rotation of the crankshaft in one direction a first stop will engage one side of the dog and rotate the cam to a first prescribed angular position on the crankpin to produce one piston stroke length. Conversely, reversing the rotation of the crankshaft disengages the dog from the first stop and causes the cam to rotate and engage the opposite side of the dog to a second stop, which also rotates the cam to a second prescribed angular position on the crankpin to produce another piston stroke length.

A compressor operates by drawing gas into a chamber and compressing the gas during a compression cycle. The end of the compression cycle is when the discharge of gas from the compression chamber ends and drawing of the gas into the chamber begins. Reciprocating compressors having disengageable eccentric structures typically include a piston that compresses gas inside a compression cylinder or chamber. A protrusion on the eccentric cam, called a dog, engages a stop on the crankshaft to facilitate rotation of eccentric cam structure. At the completion of the compression cycle, the compressed gas is discharged from the compression cylinder through a discharge valve in a valve plate at one end of the cylinder. The end of the compression cycle in a reciprocating compressor corresponds approximately to the top dead center position of the piston (i.e., the maximum length the piston extends into the compression cylinder). A volume of gas, commonly referred to as reexpansion gas, is not discharged from the compression cylinder and remains in the clearance space of the cylinder (i.e., the space between the valve plate and piston) at the completion of the compression cycle. The reexpansion gas remaining in the cylinder exerts force on the piston. In reciprocating compressors using a disengageable eccentric cam, a force on the piston from the reexpansion gas transfers through the piston assembly to the disengageable eccentric cam. The eccentric cam is accelerated to a rotational velocity greater than the velocity of the crankpin, which results in a slight disengagement of the disengageable eccentric cam's dog from the stop on the crankpin. The crankpin continues to rotate and the eccentric portion returns to the same velocity as the crankpin. The eventual reengagement of the stop on the crankpin with the dog on the disengageable eccentric cam occurs with substantial momentum and impact, thus producing noise, commonly referred to as chatter. Chatter is a metallic clacking or clicking noise generated by the rapid and forceful reengagement of the stop and dog.

Rotary compressors having disengageable eccentric structures are also susceptible to noise in the form of chatter. Rotary compressors include a roller having an eccentric crank mounted on a crankshaft. A protrusion on the eccentric crank, called a dog, engages a stop on the crankpin to facilitate rotation of the roller structure. The roller compresses gas inside a compression cylinder. At the completion of the compression cycle, the compressed gas is discharged from the compression cylinder through a discharge valve positioned along the inner surface of the cylinder. Like in the reciprocating compressor, a volume of reexpansion gas is not discharged from the compression cylinder and remains in the cylinder at the completion of the compression cycle. The reexpansion gas remaining in the cylinder exerts force on the roller, causing the roller and eccentric crank to accelerate to a rotational velocity greater than the crankpin. The crankpin continues to rotate and the roller and eccentric crank return to the same velocity as the crankshaft. The eventual reengagement of the stop on the crankpin with the dog on the disengageable eccentric crank occurs with substantial momentum and impact, thus producing the chatter.

The problem of chatter is not limited to reciprocating and rotary compressors. Any type of compressor having a disengageable eccentric structure may be susceptible to the problem of chatter.

One attempt to address the problem of disengagement and reengagement of the stop and dog includes placing locking mechanisms for the disengageable eccentric structure on the disengageable eccentric cam. For example, U.S. Pat. No. 6,092,993, herein incorporated by reference, utilizes various latching mechanisms that mechanically hold the disengageable eccentric cam and the crankpin stop together while the crankpin is rotating. However, the latching means requires additional components and/or machining on the rotating crankpin and disengageable eccentric cam to maintain engagement. Also shown in U.S. Pat. No. 6,092,993, is the attempt to address the problem of disengagement and reengagement of the stop and dog using inertial mass to hold disengageable eccentric structure against the crankpin stops. The addition of mass to the eccentric cam shifts the center of gravity of the eccentric cam and acts to provide additional force to maintain engagement while the crankpin is rotating. However, cam inertia is generally ineffective to prevent disengagement, particularly from the force against the disengageable cam caused by reexpansion gas.

What is needed is a method and/or system for reducing noise and chatter in variable capacity compressors with disengageable eccentric structures resulting from reexpansion gas remaining in the cylinder at the completion of the compression cycle.

SUMMARY OF THE INVENTION

The present invention is directed to a method and system for reducing noise in multi-capacity compressors having disengageable eccentric structures. The noise created by rapid engagement and disengagement of the disengageable eccentric structure with the crankpin is reduced or eliminated by decreasing the amount of reexpansion gas present in the compression chamber of the compressor at or near the completion of the compression cycle.

The present invention includes a multi-capacity fluid compressor including a compression chamber having a discharge end and an inner surface. The compressor also includes a compression member having a disengageable eccentric structure allowing the compressor to provide a plurality of discrete compression capacities. A valve portion is disposed adjacent to the discharge end of the compression chamber and is arranged and disposed to discharge a compressed fluid when the compression member has completed a compression cycle. A discharge arrangement is arranged and disposed to discharge at least a portion of fluid remaining in the compression chamber at the completion of the compression cycle by the compression member. The discharge of at least a portion of the fluid remaining in the compression chamber reduces or eliminates forces on the disengageable eccentric structure to limit rotational acceleration of the disengageable eccentric structure.

Another embodiment of the present invention includes a multi-capacity fluid compressor including a compression chamber having a discharge end and an inner surface. The compressor further includes a compression member having a disengageable eccentric structure allowing the compressor to provide a plurality of discrete compression capacities. The compression member is arranged and disposed to travel along a portion of the inner surface to vary the volume of the compression chamber. A valve portion is disposed adjacent to the discharge end of the compression chamber and is arranged and disposed to discharge a compressed fluid when the compression member has completed a compression cycle. An opening is disposed in one of the components selected from the group consisting of the valve portion, the compression member, the inner surface and combinations thereof. The opening is configured to discharge at least a portion of fluid remaining in the compression chamber at the completion of the compression cycle by the compression member. The discharge of at least a portion of fluid remaining in the compression chamber reduces or eliminates forces on the disengageable eccentric structure to limit rotational acceleration of the disengageable eccentric structure.

A method for reducing chatter in multi-capacity compressors comprising the steps of providing a multi-capacity compressor having a compression chamber having a discharge end and an inner surface. The compressor further includes a compression member having a disengageable eccentric structure that allows the compressor to provide a plurality of discrete compression capacities. The compression member is arranged and disposed to travel along a portion of the inner surface to vary the volume of the compression chamber. A valve portion is disposed adjacent to the discharge end of the cylinder and is arranged and disposed to discharge compressed fluid. An opening is disposed in one of the components selected from the group consisting of the valve portion, the compression member, the inner surface and combinations thereof. The method further includes compressing a fluid by decreasing the volume of the compression chamber with the compression member. A volume of compressed fluid is discharged from the valve portion when the compression member has completed compressing the fluid. Thereafter at least a portion of fluid remaining in the compression chamber is removed through the opening to reduce or eliminate forces on the disengageable eccentric structure to prevent rotational acceleration of the disengageable eccentric structure.

The method and/or system according to the present invention may be utilized with any type of compressor having a portion of the compression mechanism disengageable from the driving member during operation susceptible to chatter. In particular, the present invention is suitable for use with a multi-capacity reciprocating compressor or a multi-capacity rotary compressor.

The method and/or system according to the present invention reduces noise in a compressor having a disengageable eccentric structure without additional noise reducing components and/or machining of the rotating crankpin and disengageable eccentric structure. Further, the system according to the present invention is capable of reducing noise in a compressor having a disengageable eccentric structure with little or no loss in efficiency.

The method and/or system according to the present invention also reduces the number of disengagement and reengagements of the dog on the disengageable eccentric structure and the stop on the crankpin, decreasing the wear on the components and increasing the operational life of the system.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
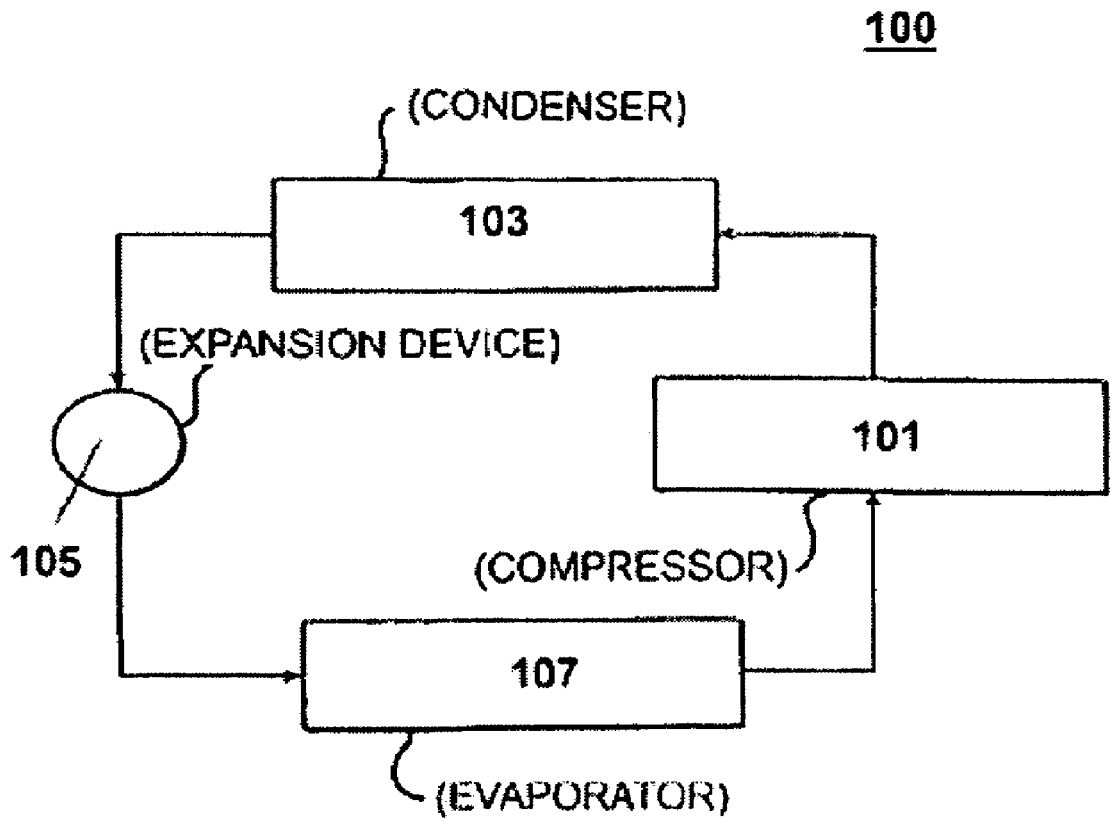
FIG. 1 illustrates schematically a refrigeration system used with the present invention.

A system to which the invention may be applied is illustrated, by means of example, in FIG. 1. As shown, the HVAC, refrigeration, or chiller system 100 includes a compressor 101, a condenser 103 and an evaporator 107. The conventional HVAC or refrigeration system includes many other features that are not shown in FIG. 1. The features not shown have been purposely omitted to simplify the drawing for ease of illustration.

The compressor 101 compresses a refrigerant vapor and delivers it to the condenser 103. The compressor 101 is preferably a reciprocating compressor, however the compressor according to the present invention is not limited to a reciprocating compressor. Any type of compressor that uses a portion of the compression mechanism disengageable from the driving member during operation (i.e., a disengageable eccentric cam structure) may utilize the present invention. Other suitable compressor types include, but are not limited to, rotary compressors, scotch yoke compressors, and scroll compressors. The refrigerant vapor delivered by the compressor 101 to the condenser 103 enters into a heat exchange relationship with a fluid, e.g., air or water, and undergoes a phase change to a refrigerant liquid as a result of the heat exchange relationship with the fluid. The condensed liquid refrigerant from condenser 103 flows though an expansion device 105 to an evaporator 107. The liquid refrigerant in the evaporator 107 enters into a heat exchange relationship with another fluid, e.g. air or water, to remove heat from the air or water. The refrigerant liquid in the evaporator 107 undergoes a phase change to a refrigerant vapor as a result of the heat exchange relationship with the air or water. The vapor refrigerant in the evaporator 107 exits the evaporator 107 and returns to the compressor 101 by a suction line to complete the cycle. It is to be understood that any suitable configuration of condenser 103 and evaporator 107 can be used in the system 100, provided that the appropriate phase change of the refrigerant in the condenser 103 and evaporator 107 is obtained.

The capacity of compressor 101 directly affects the amount of cooling provided by the refrigerant in the evaporator 107. For example, when a two-stage reciprocating compressor is operated in a maximum capacity mode, compressor 101 operates at full capacity and provides maximum cooling in the evaporator 107. When the two-stage reciprocating compressor is operated in a reduced capacity mode, the amount of cooling provided in the evaporator 107 is similarly reduced.

The multi-capacity gas compressor according to the invention includes a plurality of compression chambers, where each of the compression chambers has a discharge end, an inner surface, and a compressing component (e.g. a piston or compression roller). The compressing component is positioned in the compression chamber adjacent to the inner surface and is mounted to allow travel within the compression chamber, either axially or circumferentially. The position of the compressing component determines the volume of the compression chamber. Accordingly, the travel of the piston or roller increases or decreases the volume of the compression chamber. A reexpansion gas discharge system is positioned adjacent to the discharge end of the compression chamber, e.g., a cylinder. The reexpansion gas discharge can include an opening in the discharge end, the compressing component, the inner surface, or any combination thereof. The opening allows discharge of at least a portion of gas remaining in the compression chamber (i.e., reexpansion gas) after the compression cycle is complete.

Figure 2A:
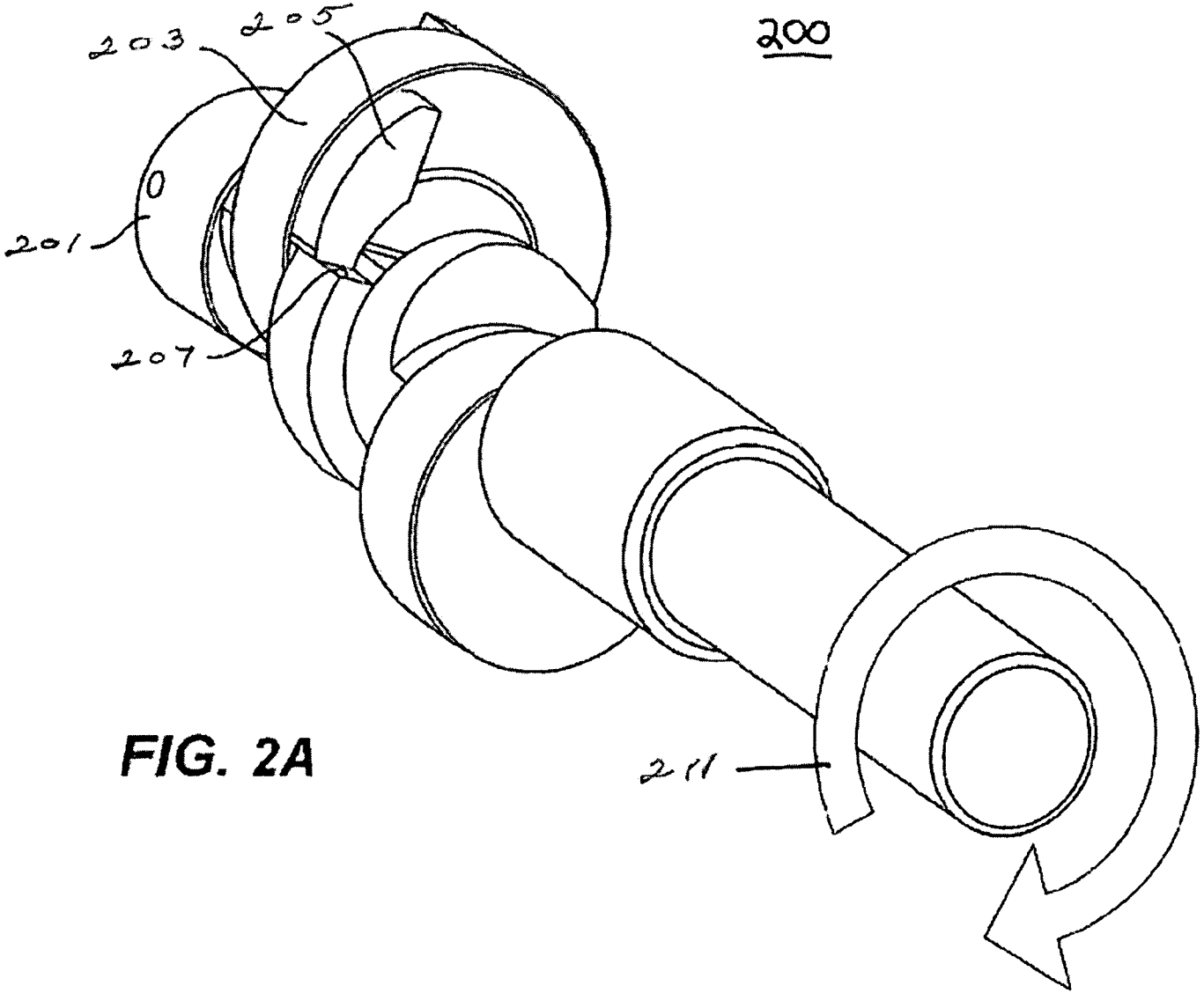
FIGS. 2A and 2B illustrate disengageable eccentric cams on rotating crankshaft assemblies.
Figure 2B:
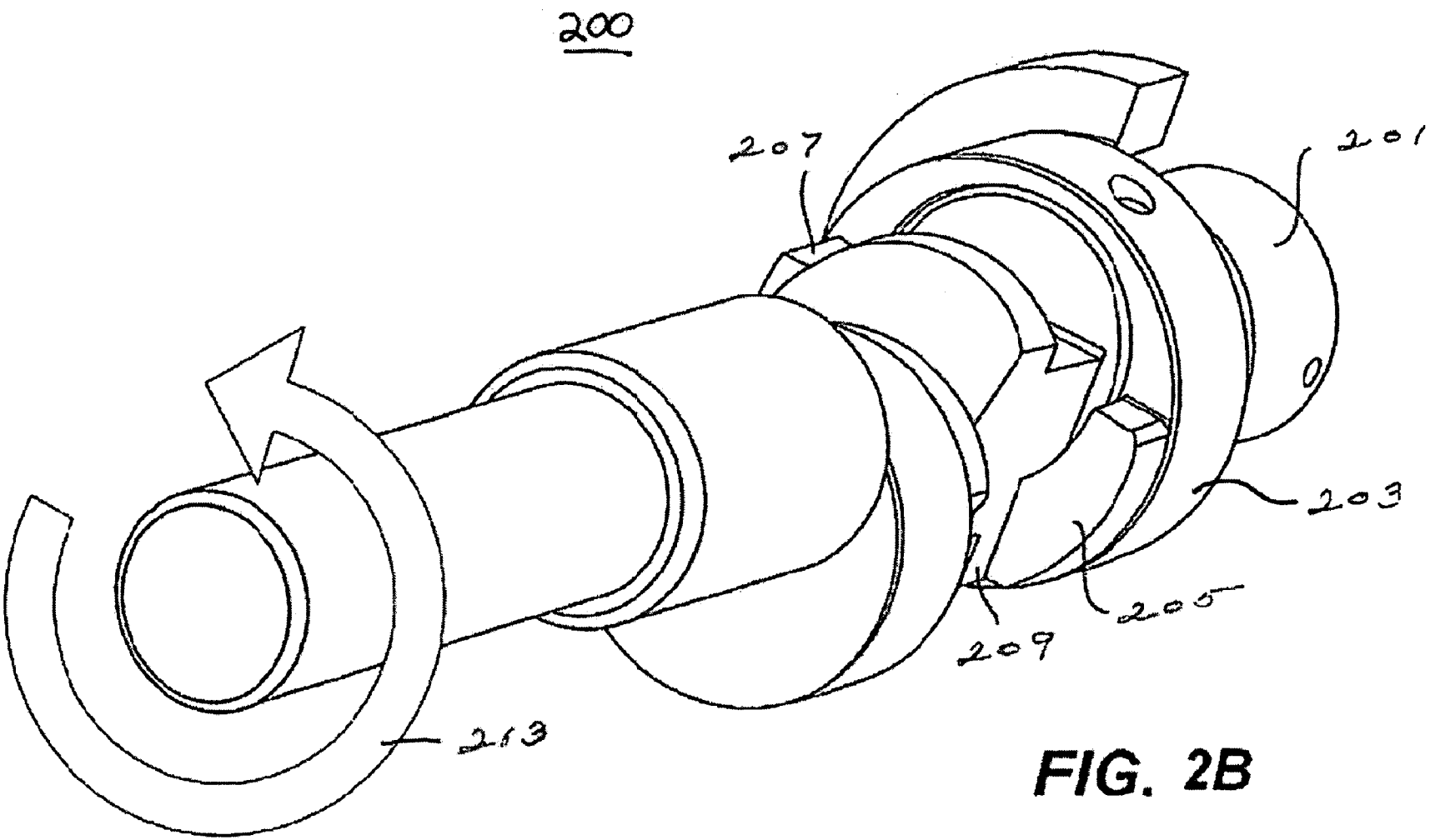

FIGS. 2A and 2B illustrate a camshaft assembly 200 for a reciprocating compressor according to the present invention. The camshaft assembly 200 includes a crankpin 201, a disengageable eccentric cam 203, a dog 205 extending from the disengageable eccentric cam 203 and a first stop surface 207. FIG. 2A illustrates the camshaft assembly 200 rotating in a rotational direction 211 that causes the disengageable eccentric cam 203 to rotate on the crankpin 201 and engage a first side of the dog 205 to the first stop surface 207. The rotational direction shown in FIG. 2A represents the direction of full compressor capacity. The disengageable cam 203 has an eccentric shape when rotated in this direction, which permits an attached piston to compress gas in the compression chamber thereby providing additional compression capacity. During operation, the engagement of the first side of the dog 205 and the first stop surface 207 is a result of the rotation of the crankpin 201. However, during operation, a force resulting from reexpansion gas in the compression cylinder causes the disengageable cam 203 to accelerate to a rotational velocity sufficient to cause disengagement at the point of contact with the first side of the dog 205 and the first stop surface 207. Noise, in the form of chatter, results from the disengageable eccentric cam 203 returning to the velocity of the crankpin 201 and reengaging the first stop surface 207.

FIG. 2B illustrates the camshaft assembly 200 rotating in a rotational direction 213 that causes the disengageable eccentric cam 203 to rotate on the crankpin 201 and engage a second side of the dog 205 to a second stop surface 209. The disengageable cam 203 has a substantially circular shape when rotated in this direction, which reduces or eliminates the motion of the piston, thereby reducing or eliminating the ability of the piston to compress gas in the compression chamber thereby providing an different compression capacity than shown in FIG. 2A. Although FIG. 2B shows a substantially circular disengageable eccentric cam 203 shape when rotating in one direction, the geometry of the disenageable eccentric cam 203 is not limited to a circular shape and may be an eccentric or other geometry that permits the piston to compress gas in the compression chamber at a different capacity than the capacity shown in FIG. 2A. During operation, the engagement of the second side of the dog 205 and the second stop surface 209 is a result of the rotation of the crankpin 201. The rotational direction illustrated in FIG. 2B results in the compressor operating at a reduced capacity. In addition, little or no noise is produced by the disenageable eccentric cam 203 from disengagement of the disengageable eccentric cam 203 from the dog 205 having the reduced or eliminated compression capacity because the presence of reexpansion gas is reduced or eliminated due to the reduced motion of the piston.

FIGS. 3 through 6 illustrates various embodiments of a piston assembly 300 incorporating the reexpansion gas discharge assembly of the invention. Piston assembly 300 illustrates a compressor piston at or near the completion of the compression stroke. The piston assembly 300 includes a piston head 301 inside of a cylinder wall 303. The piston head 301 includes a piston ring groove 305, which is capable of receiving a piston ring. A valve plate 307 is positioned adjacent to the cylinder wall 303 to form a cylindrical space. The piston head 301 is allowed to travel within the cylindrical space formed by the valve plate 307 and the cylinder wall 303. The space between the piston head 301 and the valve plate 307 is the compression chamber. As the compressor completes the compression stroke, the piston head 301 forms a clearance space between the piston head 301 and the valve plate 307. At or near the completion of the compression stroke reexpansion gas 309 remains in the space between the end of the piston head 301 and the valve plate 307.

Figure 3:
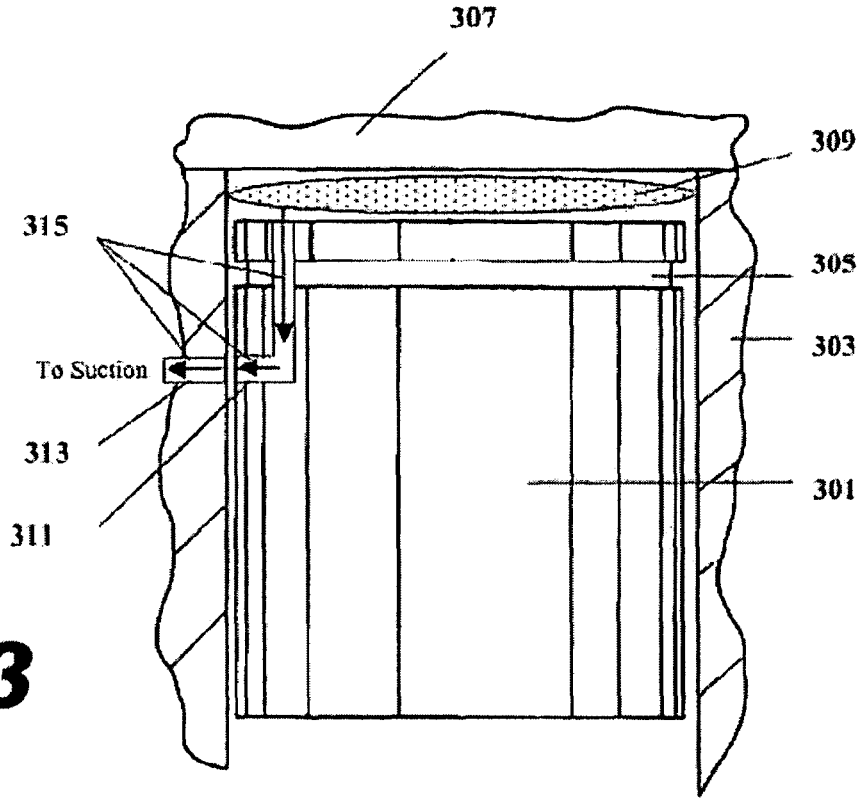
FIG. 3 illustrates a reexpansion discharge assembly according to one embodiment of the invention.

FIG. 3 illustrates an embodiment of a reexpansion gas discharge assembly according to the present invention, where the piston head 301 includes a piston exhaust passage 311 that allows reexpansion gas 309 to pass through the piston head 301 to a cylinder wall passage 313. The reexpansion gas 309 flows from the compression chamber in the cylinder, as discharged reexpansion gas 315, to the suction side of the compressor 101 through cylinder wall passage 313.

Figure 4:
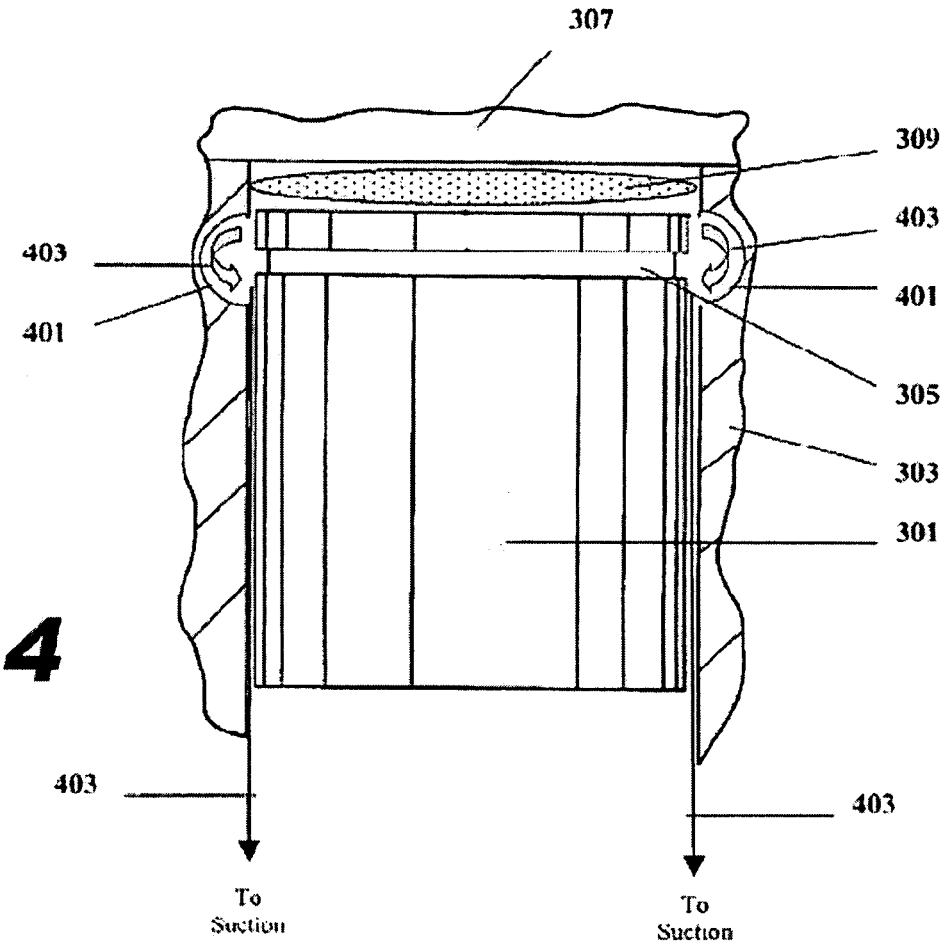
FIG. 4 illustrates a reexpansion discharge assembly according to another embodiment of the invention.

FIG. 4 illustrates an alternate embodiment of the reexpansion gas discharge assembly. The piston assembly 300 includes an exhaust indentation 401 in the cylinder wall 303 of the piston assembly 300. The exhaust indentation 401 is positioned along the length of the piston head 301 so that at or near the completion of the compression stroke, a piston ring positioned in the piston ring groove 305 releases reexpansion gas 309 through the exhaust indentation 401, as discharged reexpansion gas 403. In other words, the reexpansion gas can bypass the piston ring through exhaust indentation 401 and does not remain in the compression chamber, but is vented to the suction side of the compressor.

Figure 5:
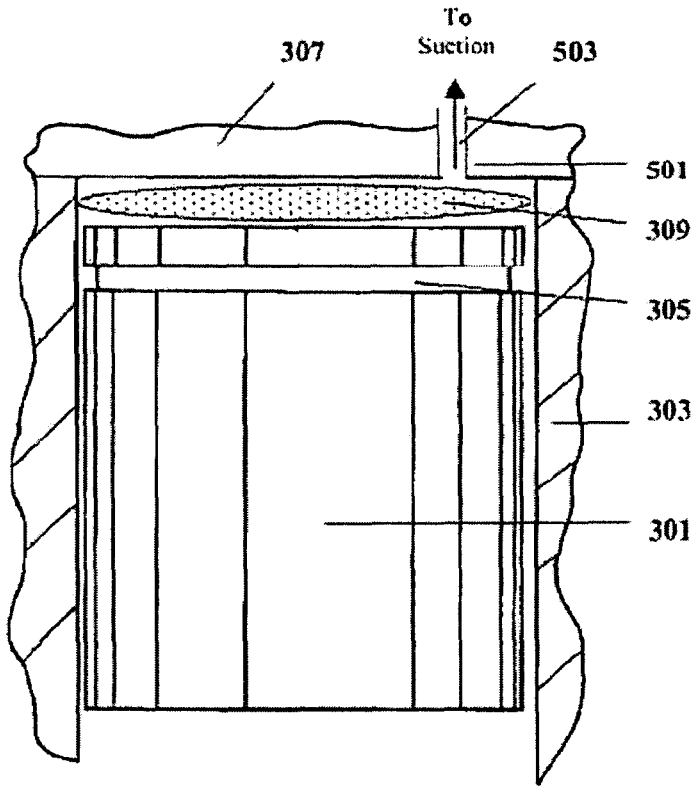
FIG. 5 illustrates a reexpansion discharge assembly according to still another embodiment of the invention.

FIG. 5 illustrates a further alternate embodiment of the reexpansion gas discharge assembly. The piston assembly 300 includes an exhaust passage 501 in the valve plate 307 that allows reexpansion gas 309 to discharge through the exhaust passage 501, as discharged reexpansion gas 503. The exhaust passage 501 is positioned to discharge the discharged reexpansion gas 503 to the suction side of the compressor. The discharged reexpansion gas 503 is permitted to discharge from the reexpansion gas discharge assembly at a constant rate. The size of the exhaust passage 501 is such that reexpansion gas is removed from the compression chamber with little or no loss in compressor efficiency. The exhaust passage 501 has little or no loss in compressor efficiency because the exhaust passage 501 is configured and arranged to exhaust reexpansion gas 309, which is not part of discharge gas exhausted from the compression chamber as part of the compression cycle. Since the discharged reexpansion gas 503 is not part of the discharge gas, there is little or no efficiency loss due to the exhaust passage 501.

Figure 6:
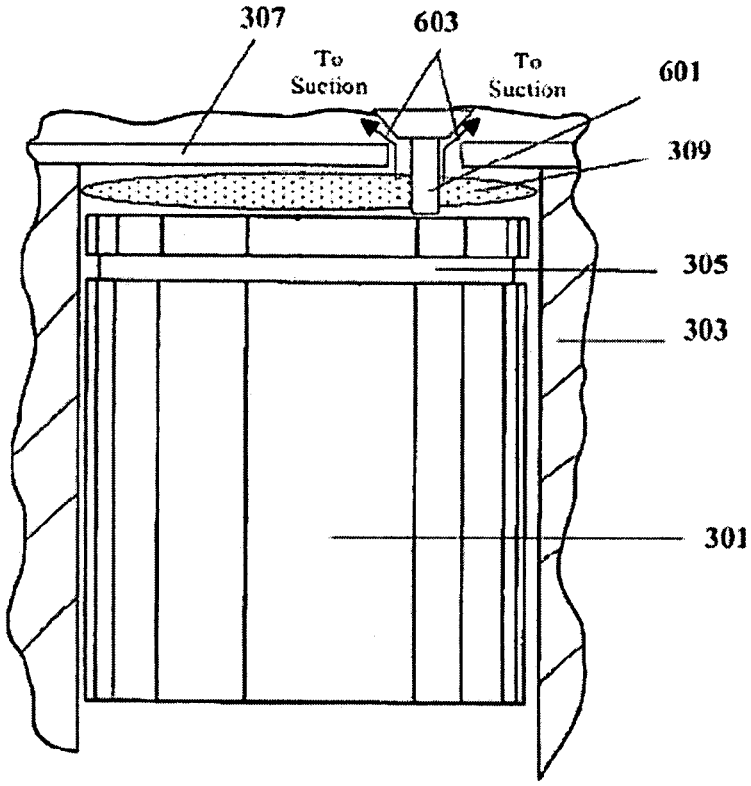
FIG. 6 illustrates a reexpansion discharge assembly according to still another embodiment of the invention.

FIG. 6 illustrates an alternate embodiment of the reexpansion gas discharge assembly. The piston assembly 300 includes a valve 601 in the valve plate 307 that is activated by the piston head 301 that allows reexpansion gas 309 to discharge through the valve 601, as discharged reexpansion gas 603. The valve 601 is positioned to discharge the discharged reexpansion gas 603 to the suction side of the compressor.

Figure 7:
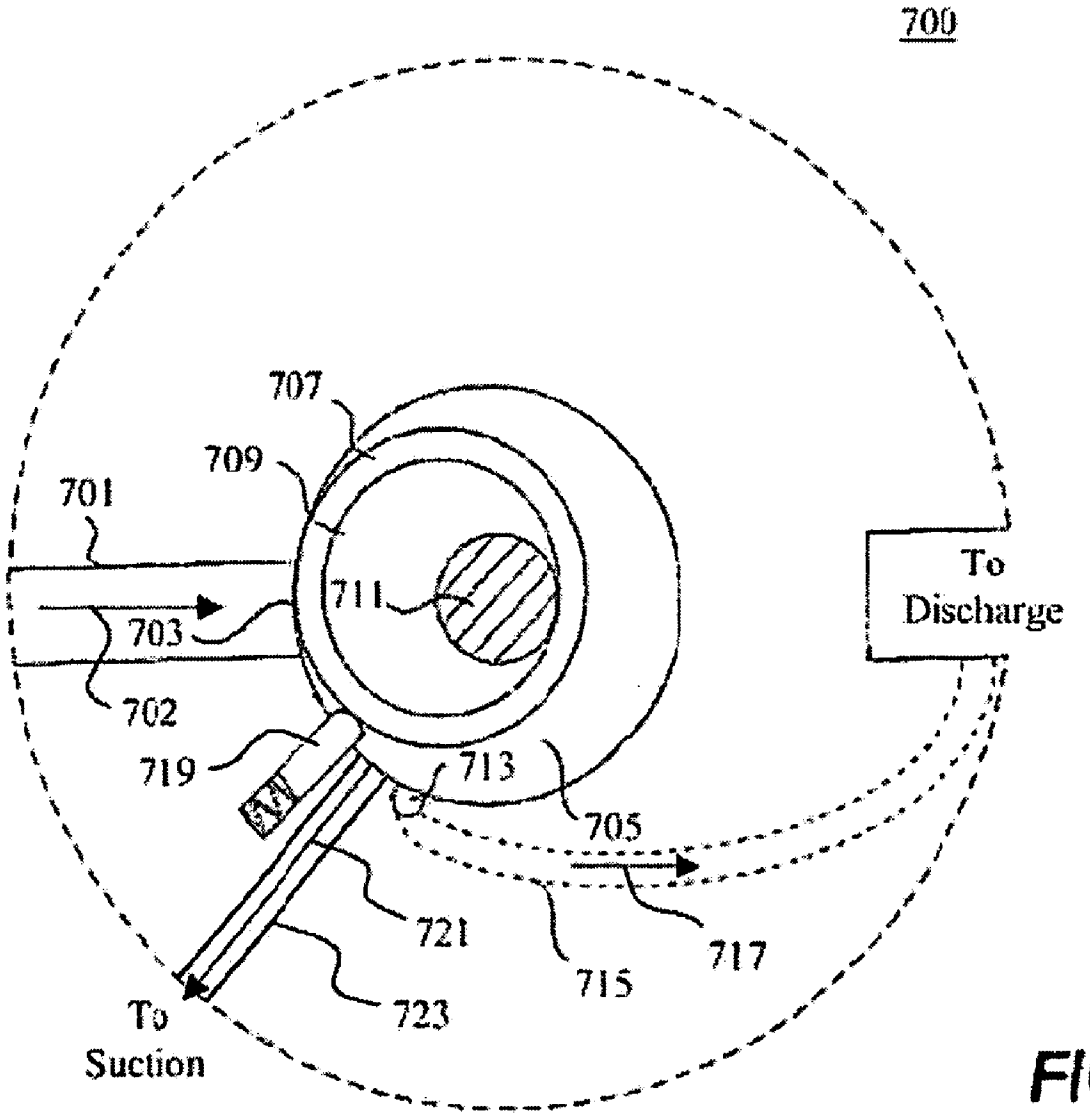
FIG. 7 illustrates a reexpansion discharge assembly according to still another embodiment of the invention.

FIG. 7 illustrates an embodiment of a rotary compression assembly 700, for a rotary compressor, having a reexpansion gas discharge assembly according to the present invention. The rotary compression assembly 700 includes an inlet channel 701 that carries inlet gas 702 into a compression chamber 705 via inlet port 703. The compression assembly 700 also includes a roller 707 and a disengageable eccentric crank 709 mounted on a crankpin 711. During a compression cycle, the crankpin 711 rotates the roller 707 and the disengageable eccentric crank 709 inside the compression chamber 705. As the roller 707 rotates inside the compression chamber 705, a blade 719 separates the inlet port 703 from the discharge port 713. The blade 719 is in sliding contact with the roller 707 and substantially prevents the passage of gas during compressor operation. The disengageable eccentric crank 709 includes roller 707, which provides a small clearance when the crankpin 711 is rotated in one direction and a larger clearance when rotated in the opposite direction. The rotary compressor operates at a larger capacity (i.e., compresses a greater quantity of gas) when the roller or rollers provide a small clearance and a smaller capacity (i.e., compresses a smaller quantity of gas) when the roller or rollers provide a larger clearance. The clearance is measured as the smallest distance between the roller 707 and the surface of the compression chamber 705. When the clearance is small the roller 707 may contact a surface of the compression chamber 705 or may be sufficiently close to the surface of the compression chamber 705 to substantially prevent leakage of fluid through the clearance space between the roller 707 and the compression chamber 705. However, when the clearance is large, at least some leakage between the roller 707 and the surface of the compression chamber 705 is permitted. When the crankpin 711 rotates in the direction of the smaller clearance (i.e., clockwise, as shown in FIG. 7), the gas inside the compression chamber is compressed by the roller 707 as the crankpin 711, the disengageable eccentric crank 709 and the roller 707 rotate. At the end of the compression cycle, the compressed gas exits the compression chamber 705 through the discharge port 713, as discharge gas 717 and is carried through a discharge channel 715 to the discharge of the compressor. A reexpansion gas discharge opening 723 is positioned to discharge reexpansion gas 721 present in the compression chamber after the completion of the compression cycle. The reexpansion gas discharge opening 723 may be open to the compression chamber during the entire cycle to constantly bleed reexpansion gas from the compression chamber, or the reexpansion gas discharge opening 723 may be positioned and/or configured to open at or near the completion of the compression cycle. In either embodiment, the reexpansion gas is removed from the compression chamber and is discharged to the suction side of the compressor.

FIGS. 3-7 show and describe that reexpansion gas 309 is discharged to the suction of the compressor. Although the reexpansion gas 309 may be discharged to the suction of the compressor, the present invention is not limited to discharging to the suction of the compressor. The reexpansion gas 309 may be discharged to any location that has a lower pressure than the reexpansion gas 309 in the compression chamber at or near the end of the compression stroke. For example, the reexpansion gas 309 may be discharged to any area, such as chambers, ports or cavities having a fluid pressure lower than the fluid pressure of the reexpansion gas 309 in the compressor system.

The discharge of reexpansion gas 309 from the compression chamber either takes place through an opening in the compression chamber or through a valve activated at or near the completion of the compression cycle. The opening in the chamber according the present invention includes openings that allow constant passage of at least some gas, or openings that allow passage of gas only at predetermined positions of the compressing component in the compression cycle.

In one embodiment having an opening allowing the constant passage of at least some gas, the gas is permitted to discharge from the compression chamber to either an opening in the valve plate 307, as illustrated in FIG. 5, an opening in the cylinder wall 303, as illustrated in FIG. 7, or an opening in the piston head 301. The opening allows the discharge of reexpansion gas from the clearance space in the compression chamber in order to reduce or eliminate the force on the disengageable eccentric structure.

In one embodiment having an opening that allows passage of gas only at predetermined positions of the compression member, the piston assembly 300 may include a passage in the piston head 301 that aligns with a passage in the cylinder wall, as illustrated in FIG. 3, at or near the completion of the compression cycle to allow discharge of reexpansion gas 309 from the compression chamber. Alternatively, the cylinder may include an exhaust indentation 401 (i.e., cavity), as illustrated in FIG. 4, that permits discharge of reexpansion gas 309 from the compression chamber at or near the end of the compression cycle when the piston ring is positioned at or near the exhaust indentation 401. The discharge of reexpansion gas 309 takes place when the piston ring travels past the exhaust indentation 401 in the compression cycle.

Alternatively, the cylinder may also include a valve 601, as illustrated in FIG. 6, that opens at a predetermined position of the compressing component in the compression cycle to allow discharge of reexpansion gas from the cylinder. Valve 601 may be operated in any manner that opens the valve 601 at or near the completion of the compression cycle. For example, the valve 601 may be positioned in a location in which the valve 601 is opened by contact with the piston head 301 when the piston head 301 substantially reaches the completion of the compression cycle. Although FIG. 6 depicts a mechanically operated valve, the invention is not limited to a valve that is mechanically operated. Any valve that is capable of opening at a predetermined point in the compression cycle is suitable for use in the present invention. Alternative valves include, but are not limited to, pneumatic valves or solenoid valves.

In accordance with one embodiment, the present invention is directed to a reciprocating compressor. The compressor includes a reversible motor for rotating in a forward and a reverse direction and a block with a plurality of cylinders and the associated compression chambers each having a single piston. One or more of the pistons include a disengageable eccentric cam system between the motor and the piston or pistons for driving the piston or pistons at a full stroke between a bottom position and a top dead center position when the motor is operated in the forward direction. The piston with the disengageable eccentric cam is driven at a reduced stroke between an intermediate position and the bottom position when the motor is operated in the reverse direction. The structure supporting the cylinders includes an opening for the appropriate cylinders that allows the discharge of reexpansion gas at or near the completion of the compression cycle (i.e., at or near the top dead center position of the stroke). Alternatively, the structure supporting the cylinders may include a valve 601 that is opened for the appropriate cylinders at or near the end of the compression cycle to discharge at least a portion of the reexpansion gas.

In accordance with another embodiment of the present invention, the invention is directed to a two-stage reciprocating compressor. In this embodiment, the compressor includes a reversible motor for rotating in either a forward or a reverse direction and a structure for supporting one or more cylinders having a single cylinder, an associated single compression chamber, and a single piston. A mechanical system is provided between a motor and the single piston for driving the piston within the cylinder between a bottom position and a top dead center position when the motor is operated in the forward direction. The space formed within the cylinder by the piston is the compression chamber. When a reduced capacity is desired, the piston is driven at a reduced stroke between an intermediate position and the top dead center position by operating the motor in a reverse direction. In order to discharge reexpansion gas, an opening is provided in the structure supporting the cylinders permitting discharge of reexpansion gas at or near the completion of the compression cycle (i.e., at or near the top dead center position of the stroke). Alternatively, the structure having the cylinder may include a valve 601 that is opened at or near the end of the compression cycle to discharge at least a portion of the reexpansion gas 309.

In accordance with still another embodiment of the present invention, the invention is directed to a rotary compressor. The compressor includes a reversible motor for rotating in a forward and a reverse direction and a plurality of compression chambers and associated compression rollers. One or more of the compression rollers are mechanically connected to a disengageable eccentric structure driven by the crankpin and the motor. The disengageable eccentric system includes a compression roller or rollers that provide a small clearance when the motor is operated in one direction and a larger clearance when operated in the opposite direction. The rotary compressor operates at a larger capacity (i.e., compresses a greater quantity of gas) when the roller or rollers provide a small clearance and a smaller capacity (i.e., compresses a smaller quantity of gas) when the roller or rollers provide a larger clearance. The cylinders containing the compression rollers include an opening that allows the discharge of reexpansion gas remaining in the cylinder at or near the completion of the compression cycle (i.e., at or near the point where the discharge of gas is complete and the drawing in of gas begins). Alternatively, the structure that includes the cylinder may include a valve 601 that is opened at or near the end of the compression cycle to discharge at least a portion of the reexpansion gas 309.

The compressor according to the present invention is not limited to reciprocating compressors or rotary compressors. Any type of compressor that uses a portion of compression mechanism disengageable from the driving member during operation (i.e., a disengageable eccentric structure) may utilize the present invention. Other suitable compressor types include, but are not limited to, scotch yoke compressors, and scroll compressors.

In accordance with a further embodiment of the present invention, the compressor having the system for reducing the amount of reexpansion gas in the compression chamber at or near the end of the compression cycle may be used in a variety of commercial or residential applications utilizing a refrigeration cycle. For example, the present invention may be utilized in a heating, ventilating, and air conditioning ("HVAC") system to condition air within an enclosure. The HVAC system includes a two-stage compressor having an opening in a compression cylinder and/or compression component to discharge reexpansion gas. The compressor is operable at either a first stage with a first capacity or at a second stage with a second, reduced capacity.

According to another embodiment, the invention is directed to a refrigerator appliance that includes a two-stage compressor having an opening in the compression cylinder and/or compression component to discharge reexpansion gas. The compressor is operable at either a first stage with a first capacity or at a second stage with a second, reduced capacity. Preferably, the compressor is continuously operated in the reduced capacity mode until a high cooling demand, such as opening the door or introducing a load of relatively warm perishables, is placed on the refrigerator. When high demand is required, the compressor may be switched to the first, increased, capacity to compensate for the increased demand.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A multi-capacity fluid compressor comprising:

a compression chamber having a discharge end and an inner surface;

a compression member having a disengageable eccentric structure allowing the compressor to provide a plurality of discrete compression capacities, the compression member being arranged and disposed to travel along a portion of the inner surface to vary the volume of the compression chamber;

a valve portion disposed adjacent to the discharge end of the compression chamber, the valve portion being arranged and disposed to discharge a compressed fluid when the compression member has completed a compression cycle;

a discharge arrangement being arranged and disposed to discharge at least a portion of fluid remaining in the compression chamber at the completion of the compression cycle by the compression member, wherein the discharge of at least a portion of fluid remaining in the compression chamber reduces or eliminates forces on the disengageable eccentric structure to limit rotational acceleration of the disengageable eccentric structure; and wherein the discharge arrangement includes an unobstructed passage disposed in one of the components selected from the group consisting of the compression member, the inner surface and combinations thereof, and is selectively in fluid communication with a lower fluid pressure area upon completion of the compression stroke.

2. The compressor of claim 1, wherein the disengageable eccentric structure is configured to allow the compression structure to generate two discrete compression capacities.

3. The compressor of claim 2, wherein the disengageable eccentric structure is mounted on a rotatable shaft and is configured to provide a first compression capacity when the rotatable shaft rotates in a first direction and a second compression capacity when the rotatable shaft rotates in a second direction.

4. The compressor of claim 3, wherein the reduction in rotational acceleration of the disengageable eccentric structure prevents disengagement of the disengageable eccentric structure from the rotatable shaft when the rotatable shaft is rotating in one of the first direction or second direction.

5. The compressor of claim 1, wherein the discharge arrangement comprises an opening configured and disposed to provide fluid communication between the compression chamber and an area of lower fluid pressure upon completion of the compression cycle.

6. The compressor of claim 1, wherein the compression member includes a piston reciprocably mounted in the compression chamber.

7. The compressor of claim 1, wherein the compression member includes a compression roller rotatably mounted in the compression chamber.

8. A multi-capacity fluid compressor comprising:

a compression chamber having a discharge end and an inner surface;

a compression member having a disengageable eccentric structure allowing the compressor to provide a plurality of discrete compression capacities, the compression member being arranged and disposed to travel along a portion of the inner surface to vary the volume of the compression chamber;

a valve portion disposed adjacent to the discharge end of the compression chamber, the valve portion being arranged and disposed to discharge a compressed fluid when the compression member has completed a compression cycle; and an unobstructed passage disposed in one of the components selected from the group consisting of the compression member, the inner surface and combinations thereof, the opening being configured to discharge at least a portion of fluid remaining in the compression chamber at the completion of the compression cycle by the compression member, wherein the discharge of at least a portion of fluid remaining in the compression chamber reduces or eliminates forces on the disengageable eccentric structure to limit rotational acceleration of the disengageable eccentric structure.

9. The compressor of claim 8, wherein the disengageable eccentric structure is configured to allow the compressor to operate at two discrete compression capacities.

10. The compressor of claim 8, wherein the disengageable eccentric structure is mounted on a rotatable shaft and is configured to provide a first compression capacity when the rotatable shaft rotates in a first direction and a second compression capacity when the shaft rotates in a second direction.

11. The compressor of claim 10, wherein the reduction in rotational acceleration prevents disengagement of the disengageable eccentric structure from the rotatable shaft when the rotatable shaft is rotating in one of the first directions and second directions.

12. The compressor of claim 8, wherein the opening includes an opening in the inner surface and an opening is in the compression member, the opening in the inner surface and the opening in the compression member being selectively in fluid communication with the suction side of the compressor upon completion of the compression cycle.

13. The compressor of claim 8, wherein the opening includes a cavity in the inner surface selectively in fluid communication with a lower fluid pressure area upon completion of the compression stroke.

14. The compressor of claim 8, wherein the compression member includes a piston reciprocably mounted in the compression chamber.

15. The compressor of claim 8, wherein the compression member includes a compression roller rotatably mounted in the compression chamber.

16. A method for reducing chatter in multi-capacity compressors comprising the steps of:

providing a multi-capacity compressor comprising:

a compression chamber having a discharge end and an inner surface;

a compression member having a disengageable eccentric structure configured to allow the compressor to provide a plurality of discrete compression capacities, the compression member being arranged and disposed to travel along a portion of the inner surface to vary the volume of the compression chamber;

a valve portion disposed adjacent to the discharge end of the cylinder, the valve portion being arranged and disposed to discharge compressed fluid; and an unobstructed passage disposed in one of the components selected from the group consisting of the compression member, the inner surface and combinations thereof, compressing a fluid by decreasing the volume of the compression chamber with the compression member;

discharging a volume of compressed fluid through the valve portion when the compression member has completed compressing the fluid; and thereafter removing at least a portion of fluid remaining in the compression chamber through the opening to reduce or eliminate forces on the disengageable eccentric structure to prevent rotational acceleration of the disengageable eccentric structure.

17. The method of claim 16, wherein the disengageable eccentric structure is configured to allow the compressor to operate at two discrete compression capacities.

18. The method of claim 16, rotating the disengageable eccentric structure in a first direction to compress fluid at a first compression capacity.

19. The method of claim 18, rotating the disengageable eccentric structure in a second direction to compress fluid at a second compression capacity.

20. The method of claim 17, wherein the rotational acceleration is sufficiently reduced to prevent disengagement of the disengageable eccentric structure from the rotatable shaft.

21. The method of claim 17, wherein compressing a fluid includes displacing the compression member by a first amount for a first compression capacity.

22. The method of claim 21, wherein compressing a fluid includes displacing the compression member by a second amount for a second compression capacity.

23. The method of claim 16, wherein the opening further comprises opening a valve and discharging fluid from the compression chamber upon completion of the compression stroke.

24. The method of claim 16, wherein the opening includes an opening in the inner surface and an opening in the compression member selectively in fluid communication upon completion of the compression stroke.

25. The compressor of claim 16, wherein the opening includes a cavity in the inner surface selectively in fluid communication with a lower fluid pressure area upon completion of the compression stroke.

26. The compressor of claim 16, wherein the compression member includes a piston reciprocably mounted in the compression chamber.

27. The compressor of claim 16, wherein the compression member includes a compression roller rotatably mounted in the compression chamber.

* * * * *